US008471443B2

(12) United States Patent
Choi et al.

(10) Patent No.: US 8,471,443 B2
(45) Date of Patent: Jun. 25, 2013

(54) LIGHTING DEVICE

(75) Inventors: Tae Young Choi, Seoul (KR); Sungho Hong, Seoul (KR); Seok Jin Kang, Seoul (KR); Dong Soo Kim, Seoul (KR)

(73) Assignee: LG Innotek Co., Ltd., Seoul (KR)

( * ) Notice: Subject to any disclaimer, the term of this patent is extended or adjusted under 35 U.S.C. 154(b) by 0 days.

(21) Appl. No.: 12/941,507

(22) Filed: Nov. 8, 2010

(65) Prior Publication Data

US 2011/0109215 A1 May 12, 2011

(30) Foreign Application Priority Data

Nov. 9, 2009 (KR) ..... 10-2009-0107498
Apr. 7, 2010 (KR) ..... 10-2010-0032060

(51) Int. Cl.
*H01J 1/02* (2006.01)

(52) U.S. Cl.
USPC ..... 313/45; 362/373; 362/362

(58) Field of Classification Search
USPC ..... 257/40, 72, 98–100, 642–643, 759; 313/498–512, 45; 315/169.1, 169.3; 427/58, 427/64, 66, 532–535, 539; 428/690–691, 428/917; 438/26–29, 34, 82, 455; 445/24–25; 362/543–549, 555, 800, 249.01–249.03, 362/362, 373
See application file for complete search history.

(56) References Cited

U.S. PATENT DOCUMENTS

| | | | | |
|---|---|---|---|---|
| 7,559,674 | B2 * | 7/2009 | He et al. | 362/249.02 |
| 2002/0004251 | A1 * | 1/2002 | Roberts et al. | 438/26 |
| 2004/0264135 | A1 * | 12/2004 | MacGregor | 361/704 |
| 2005/0218524 | A1 | 10/2005 | Japp et al. | |
| 2006/0193139 | A1 | 8/2006 | Sun et al. | 362/373 |
| 2006/0227558 | A1 | 10/2006 | Osawa et al. | |
| 2007/0041220 | A1 * | 2/2007 | Lynch | 362/646 |
| 2007/0133203 | A1 | 6/2007 | Chen | 362/235 |
| 2007/0279906 | A1 * | 12/2007 | He et al. | 362/253 |
| 2008/0025028 | A1 * | 1/2008 | Gloisten et al. | 362/294 |
| 2008/0291677 | A1 | 11/2008 | Chen | |
| 2009/0166895 | A1 | 7/2009 | Noguchi et al. | |
| 2009/0237940 | A1 * | 9/2009 | Wu et al. | 362/280 |
| 2009/0261707 | A1 | 10/2009 | Liu et al. | |
| 2010/0001309 | A1 * | 1/2010 | Wang et al. | 257/99 |
| 2010/0061098 | A1 | 3/2010 | Horng et al. | |

FOREIGN PATENT DOCUMENTS

| | | | |
|---|---|---|---|
| CN | 1838855 | A | 9/2006 |
| CN | 1880844 | A | 12/2006 |
| CN | 201129629 | Y | 10/2008 |
| CN | 101390191 | A | 3/2009 |
| CN | 201221693 | Y | 4/2009 |

(Continued)

OTHER PUBLICATIONS

Partial European Search Report dated Mar. 14, 2012 (10190506.5-1264/2320133).

(Continued)

*Primary Examiner* — Donald Raleigh
(74) *Attorney, Agent, or Firm* — Ked & Associates LLP

(57) ABSTRACT

Disclosed is a lighting device. The lighting device includes:
a substrate;
a light emitting device disposed on the substrate;
a driving unit supplying electric power to the light emitting device and connected to the substrate through a conductive line;
a heat radiating body radiating heat from the light emitting devices and comprising a hole through which the conductive line to pass; and
an insulator coupled with the hole and having a opening.

19 Claims, 13 Drawing Sheets

FOREIGN PATENT DOCUMENTS

| | | | |
|---|---|---|---|
| CN | 201237095 | Y | 5/2009 |
| CN | 101471316 | A | 7/2009 |
| CN | 101471337 | | 7/2009 |
| CN | 101672432 | A | 3/2010 |
| JP | 2006-331817 | A | 12/2006 |
| JP | 2008-204671 | | 9/2008 |
| KR | 10-496522 | | 6/2005 |
| KR | 10-2008-0088890 | | 10/2008 |
| KR | 10-2009-0046120 | | 5/2009 |
| KR | 10-2009-0066262 | | 6/2009 |
| KR | 10-2009-0072768 | | 7/2009 |
| KR | 10-2009-0095903 | | 9/2009 |
| KR | 20-2009-0009585 | | 9/2009 |
| KR | 10-2009-0119287 | | 11/2009 |
| KR | 10-2010-0002663 | | 1/2010 |

OTHER PUBLICATIONS

Partial European Search Report dated Mar. 14, 2012 (10190506.5-1264/2320134).

U.S. Office Action for U.S. Appl. No. 12/941,493 dated Dec. 22, 2011.

U.S. Office Action for U.S. Appl. No. 12/941,493 dated Sep. 5, 2012.

Chinese Office Action dated Sep. 28, 2012 with English translation.

Chinese Office Acted dated Dec. 17, 2012 issued in Application No. 201010611024.2 (with English translation).

Chinese Office Action dated Dec. 28, 2012 issued in Application No. 201010621767.8 (with English translation).

* cited by examiner

LIGHTING DEVICE

The present application claims priority under 35 U.S.C. §119(e) of Korean Patent Applications Nos. 10-2009-0107498 filed on Nov. 9, 2009 and 10-2010-0032060 filed on Apr. 7, 2010, which is hereby incorporated by reference in its entirety.

BACKGROUND

1. Field

This embodiment relates to a lighting device.

2. Description of the Related Art

A light emitting diode (LED) is a semiconductor element for converting electric energy into light. The LED has advantages of low power consumption, a semi-permanent span of life, a rapid response speed, safety and an environment-friendliness. Therefore, many researches are devoted to substitution of the existing light sources with the LED. The LED is now being increasingly used as a light source for lighting devices, for example, various lamps used interiorly and exteriorly, a liquid crystal display device, an electric sign and a street lamp and the like.

SUMMARY

One embodiment is a lighting device. The lighting device includes:

a substrate;

a light emitting device disposed on the substrate;

a driving unit supplying electric power to the light emitting device and connected to the substrate through a conductive line;

a heat radiating body radiating heat from the light emitting devices and comprising a hole through which the conductive line to pass; and an insulator coupled with the hole and having a opening.

Another embodiment is a lighting device. The lighting device includes:

a substrate:

a light emitting device disposed on the substrate;

a heat radiating body radiating heat generated from the light emitting device and a hole through which a conductive line to pass in order to supply electric power to the light emitting device; and an insulating means preventing the heat radiating body from electrically contacting with the conductive line.

Further another embodiment is a lighting device. The lighting device includes:

a heat radiating body comprising a first receiving groove on one side thereof and a second receiving groove on the other side thereof;

a light emitting module substrate disposed in the first receiving groove;

a driving unit disposed in the second receiving groove and electrically connected to the light emitting module substrate through a conductive line, wherein the heat radiating body comprises:

a hole on one side of the first receiving groove such that a conductive line passes through the hole; and an insulator surrounding an inner circumferential surface of the heat radiating body, the inner circumferential surface being formed by the hole.

DETAILED DESCRIPTION OF THE EMBODIMENTS

Hereinafter, an embodiment will be described in detail with reference to the accompanying drawings.

It will be understood that when an element is referred to as being 'on' or "under" another element, it can be directly on/under the element, and one or more intervening elements may also be present.

Figure 1:
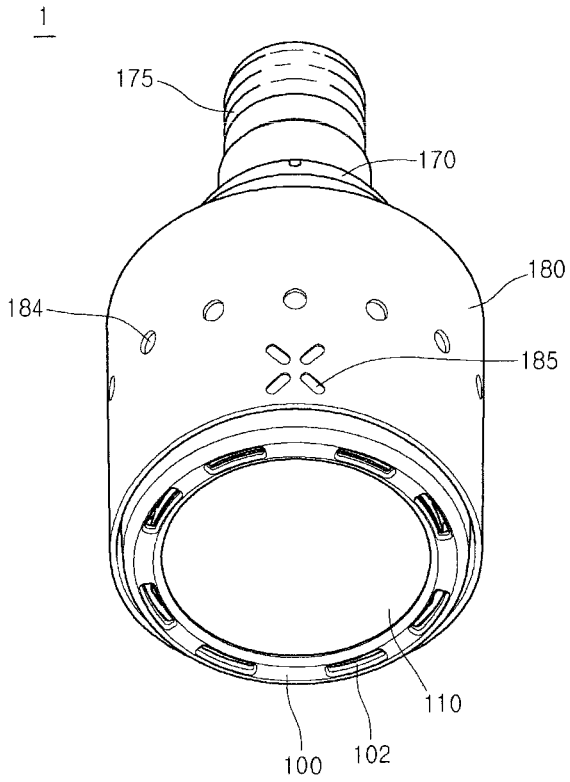
FIG. 1 is a bottom perspective view of a lighting device according to an embodiment of the present invention.
Figure 2:
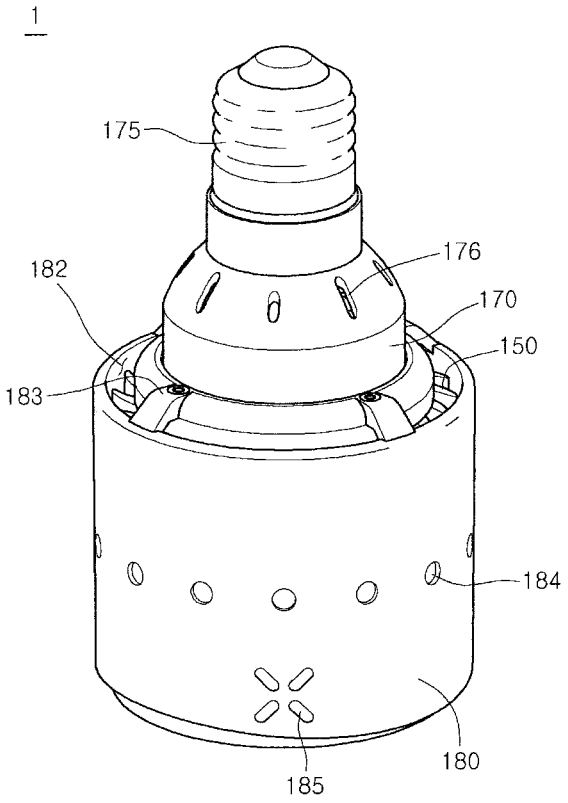
FIG. 2 is a top perspective view of the lighting device of FIG. 1.
Figure 3:
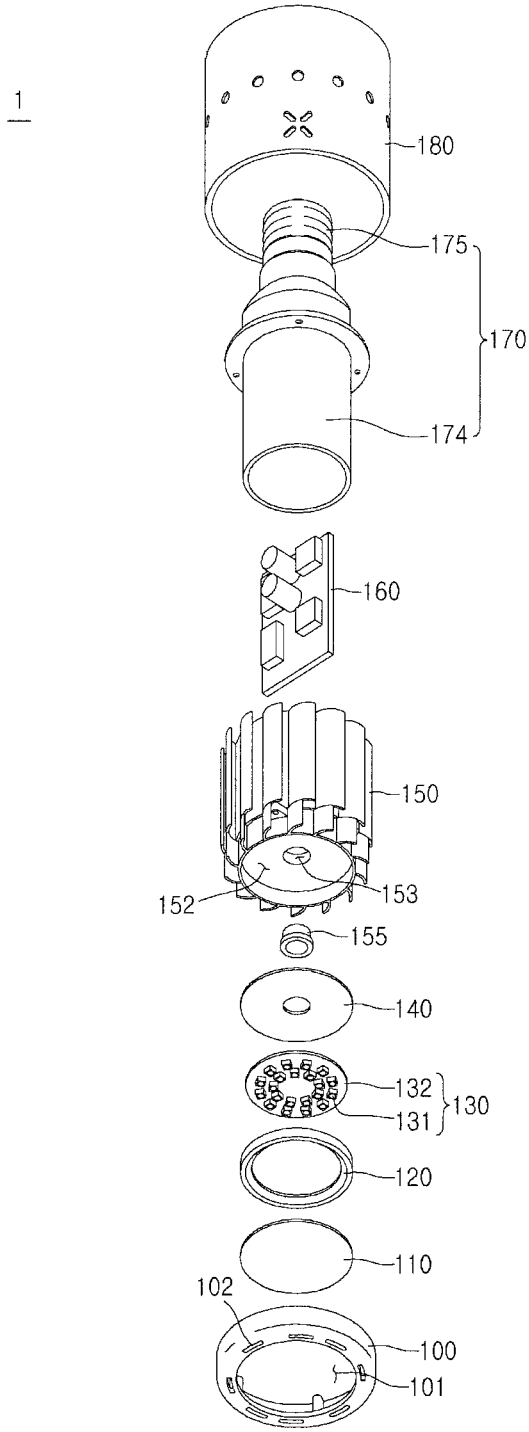
FIG. 3 is an exploded perspective view of the lighting device of FIG. 1.
Figure 4:
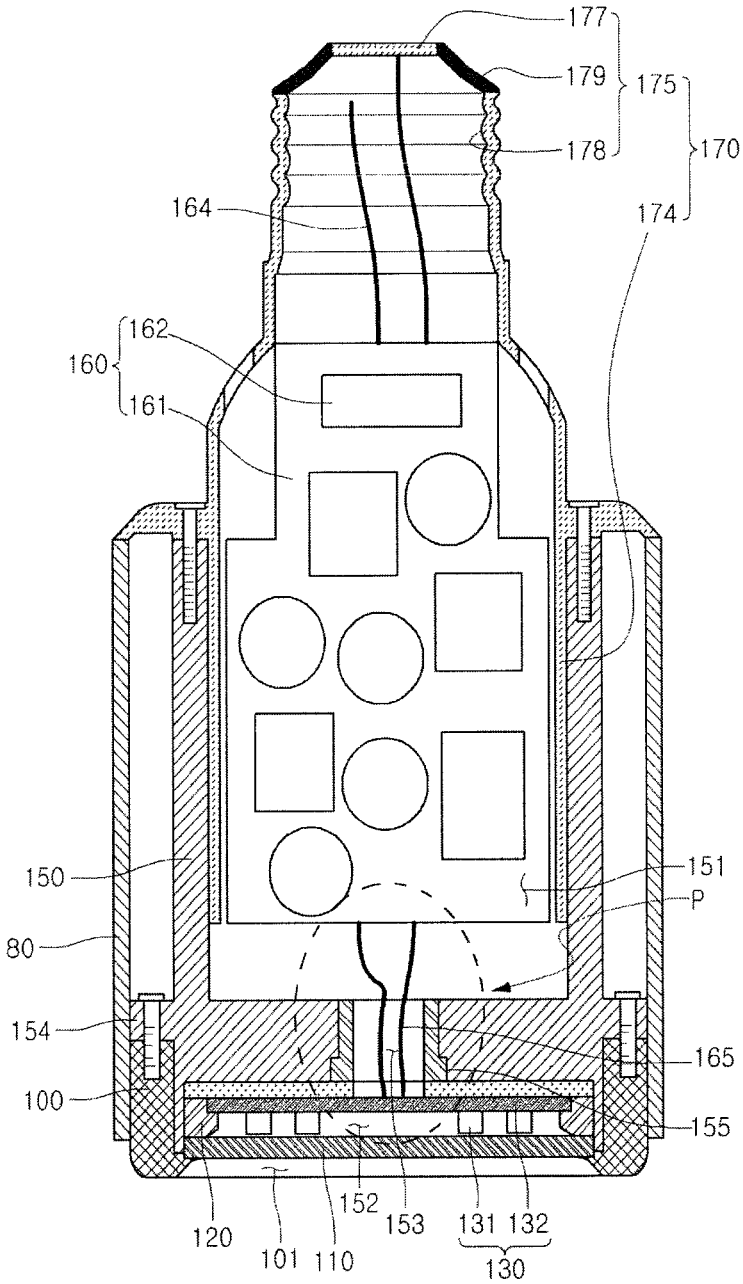
FIG. 4 is a cross sectional view of the lighting device of FIG. 1.

FIG. 1 is a bottom perspective view of a lighting device 1 according to an embodiment of the present invention. FIG. 2 is a top perspective view of the lighting device 1. FIG. 3 is an exploded perspective view of the lighting device 1. FIG. 4 is a cross sectional view of the lighting device 1.

Referring to FIGS. 1 to 4, the lighting device 1 includes an inner case 170 of which the upper part includes a connection terminal 175 and of which the lower part includes an insertion unit 174, a heat radiating body 150 including a first receiving groove 151 into which the insertion unit 174 of the inner case 170 is inserted, a light emitting module substrate 130 emitting light onto a bottom surface of the heat radiating body 150 and including one or a plurality of light emitting devices 131, a guide member 100 being coupled to the circumference of the lower part of the heat radiating body 150 and strongly fixing the light emitting module substrate 130 to the heat radiating body 150, and an outer case 180 outside the heat radiating body 150.

The heat radiating body 150 includes receiving grooves 151 and 152 on both sides thereof and receives the light emitting module substrate 130 and a driving unit 160. The heat radiating body 150 functions to radiate heat generated from the light emitting module substrate 130 or/and the driving unit 160.

Specifically, as shown in FIGS. 3 and 4, the first receiving groove 151 into which the driving unit 160 is inserted is formed on a top surface of the heat radiating body 150. A second receiving groove 152 into which the light emitting module substrate 130 is inserted is formed on the bottom surface of the heat radiating body 150.

An outer surface of the heat radiating body 150 has a prominence and depression structure. The prominence and depression structure causes the surface area of the heat radiating body 150 to be increased, improving heat radiation efficiency. The heat radiating body 150 is made of a metallic material or a resin material which has excellent heat radiation efficiency. However, there is no limit to the material of the heat radiating body 150. For example, the material of the heat radiating body 150 may include at least one of Al, Ni, Cu, Ag, Sn and Mg.

The light emitting module substrate 130 is disposed in the second receiving groove 152 formed on the bottom surface of the heat radiating body 150. The light emitting module substrate 130 includes a substrate 132 and either one or a plurality of the light emitting devices 131 disposed on the substrate 132.

The one or each of the plurality of the light emitting devices 131 includes at least one light emitting diode (hereinafter, referred to as LED). The LEDs include red, green, blue and white LEDs, each of which emits red, green, blue and white lights respectively. The number and kind of the LED are not limited to this.

The light emitting module substrate 130 is electrically connected to the driving unit 160 by a conductive line, etc., via a through-hole 153 passing through a basal surface of the heat radiating body 150. Therefore, the light emitting module substrate 130 can be driven by receiving electric power.

Here, a second insulation ring 155 is received in the through-hole 153. That is, an inner circumferential surface of the heat radiating body 150, which is formed by the through-hole 153, is surrounded by the second insulation ring 155. As the second insulation ring 155 is attached to the inner circumferential surface of the heat radiating body 150, it is possible to prevent moisture and impurities from penetrating between the light emitting module substrate 130 and the heat radiating body 150 and to prevent an electrical short-circuit, EMI, EMS and so on caused by contact of the conductive line with heat radiating body 150. The second insulation ring 155 can also improve a withstand voltage characteristic of the lighting device by insulating the conductive line from the heat radiating body 150.

A heat radiating plate 140 is attached to a bottom surface of the light emitting module substrate 130. The heat radiating plate 140 is attached to the second receiving groove 152. Otherwise, the light emitting module substrate 130 and the heat radiating plate 140 may be also integrally formed. The heat radiating plate 140 allows heat generated from the light emitting module substrate 130 to be more effectively transferred to the heat radiating body 150.

The light emitting module substrate 130 is securely fixed to the second receiving groove 152 by the guide member 100. The guide member 100 includes an opening 101 for exposing the one or a plurality of the light emitting devices 131 mounted on the light emitting module substrate 130. The guide member 100 can fix the light emitting module substrate 130 by pressing an outer circumferential surface of the light emitting module substrate 130 to the second receiving groove 152 of the heat radiating body 150.

The guide member 100 also includes an air flow structure for allowing air to flow between the heat radiating body 150 and the outer case 180 and maximizes heat radiation efficiency of the lighting device 1. The air flow structure may correspond to, for example, a plurality of first heat radiating holes 102 formed between an inner surface and an outer surface of the guide member 100, or a prominence and depression structure formed on the inner surface of the guide member 100. The air flow structure will be described later in detail.

At least one of a lens 110 and a first insulation ring 120 may be included between the guide member 100 and the light emitting module substrate 130.

The lens 110 includes various shapes like a convex lens, a concave lens, a parabola-shaped lens and a fresnel lens, etc., so that the distribution of light emitted from the light emitting module substrate 130 can be controlled as desired. The lens 110 includes a fluorescent material and is used to change the wavelength of light. The lens 110 is used without being limited to this.

The first insulation ring 120 not only prevents moisture and impurities from penetrating between the guide member 100 and the light emitting module substrate 130 but also leaves a space between an outer surface of the light emitting module substrate 130 and an inner surface of the heat radiating body 150, so that the light emitting module substrate 130 is prevented from contacting directly with the heat radiating body 150. As a result, it is possible to improve a withstand voltage characteristic of the lighting device 1 and to prevent EMI, EMS and the like of the lighting device 1.

As shown in FIGS. 3 and 4, the inner case 170 includes the insertion unit 174 and the connection terminal 175. The insertion unit 174 is formed in the lower part of the inner case 170 and is inserted into the first receiving groove 151 of the heat radiating body 150. The connection terminal 175 is formed in the upper part of the inner case 170 and is electrically connected to an external power supply.

A side wall of the insertion unit 174 is disposed between the driving unit 160 and the heat radiating body 150, and prevents an electrical short-circuit between them. Accordingly, it is possible to improve a withstand voltage characteristic of the lighting device 1 and to prevent EMI, EMS and the like of the lighting device 1.

The connection terminal 175 is inserted into an external power supply having a socket shape so that electric power can be supplied to the lighting device 1. However, the shape of the connection terminal 175 can be variously changed according to the design of the lighting device 1 without being limited to this.

The driving unit 160 is disposed in the first receiving groove 151 of the heat radiating body 150. The driving unit 160 includes a converter converting an alternating current supplied from an external power supply into a direct current, a driving chip controlling to drive the light emitting module substrate 130, an electrostatic discharge (ESD) protective device protecting the light emitting module substrate 130. The driving unit 160 is not limited to include other components.

The outer case 180 is coupled to the inner case 170, receives the heat radiating body 150, the light emitting module substrate 130 and the driving unit 160, and forms an external appearance of the lighting device 1.

While the outer case 180 has a circular section, the outer case 180 can be designed to have a polygon section or elliptical section and so on. There is no limit to the cross section shape of the outer case 180.

Since the heat radiating body 150 is not exposed by the outer case 180, it is possible to prevent a burn accident and an electric shock and to make it easier to handle the lighting device 1.

Hereinafter, the following detailed description will be focused on each component of the lighting device 1 according to the embodiment.

Heat Radiating Body 150 and Second Insulation Ring 155

Figure 5:
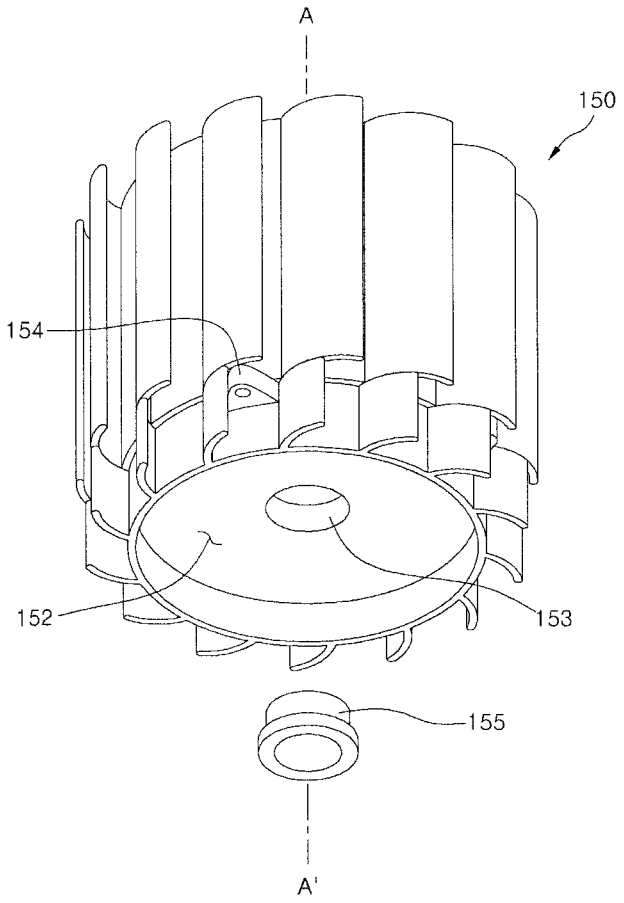
FIG. 5 is a perspective view of a heat radiating body of the lighting device of FIG. 1.
Figure 6:
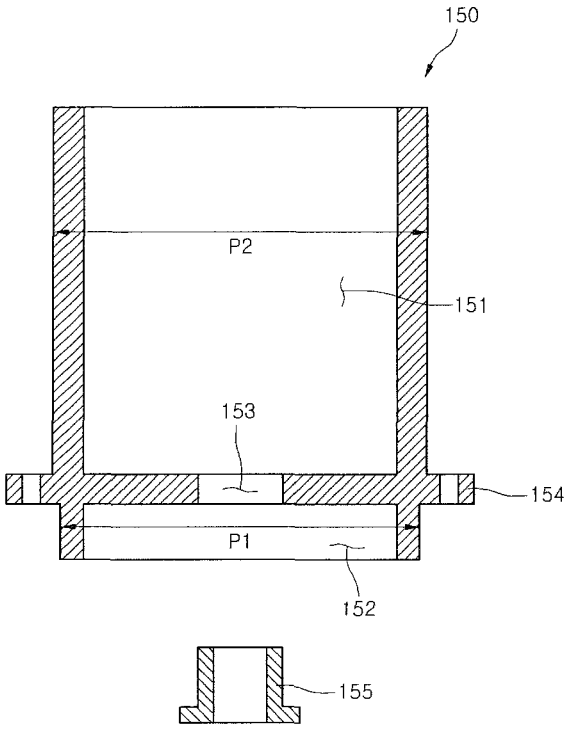
FIG. 6 is a cross sectional view taken along a line A-A' of FIG. 5.

FIG. 5 is a perspective view of the heat radiating body 150. FIG. 6 is a cross sectional view taken along a line A-N of FIG. 5.

Referring to FIGS. 4 to 6, the first receiving groove 151 in which the driving unit 160 is disposed is formed on a first side of the heat radiating body 150. The second receiving groove 152 in which the light emitting module substrate 130 is disposed is formed on a second side opposite to the first side. Widths and depths of the first and the second receiving grooves 151 and 152 are changeable depending on the widths and thicknesses of the driving unit 160 and light emitting module substrate 130.

The heat radiating body 150 is made of a metallic material or a resin material which has excellent heat radiation efficiency. However, there is no limit to the material of the heat radiating body 150. For example, the material of the heat radiating body 150 may include at least one of Al, Ni, Cu, Ag, Sn and Mg.

The outer surface of the heat radiating body 150 has a prominence and depression structure. The prominence and depression structure causes the surface area of the heat radiating body 150 to be increased, improving heat radiation efficiency. As shown, the prominence and depression structure may include a wave-shaped prominence curved in one direction. However, there is no limit to the shape of the prominence and depression.

The through-hole 153 is formed on the basal surface of the heat radiating body 150. The light emitting module substrate 130 and the driving unit 160 are electrically connected to each other by a conductive line.

Here, the second insulation ring 155 having a shape corresponding to that of the through-hole 153 is received in the through-hole 153. That is, the inner circumferential surface of the heat radiating body 150, which is formed by the through-hole 153, is surrounded by the second insulation ring 155.

As the second insulation ring 155 is attached to the inner circumferential surface of the heat radiating body 150, it is possible to prevent moisture and impurities from penetrating between the light emitting module substrate 130 and the heat radiating body 150 and to improve a withstand voltage characteristic of the lighting device by insulating the heat radiating body 150 from the conductive line passing through the through-hole 153. Here, the second insulation ring 155 is required to have an elastic material. More specifically, the second insulation ring 155 is required to be formed of a rubber material, a silicon material or other electrical insulating material.

Figure 7:
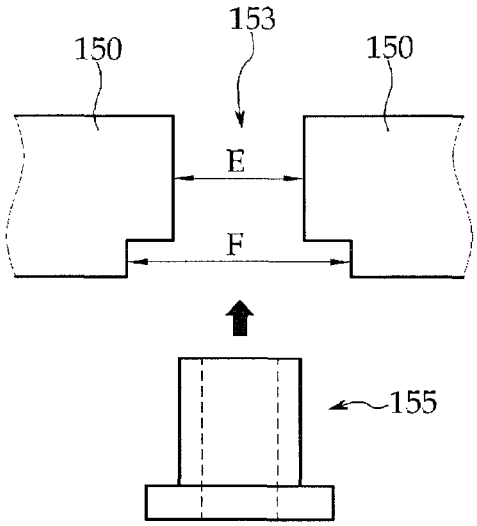
FIG. 7 is a front view for describing a second insulation ring and the heat radiating body. Part (a) of FIG. 8 is a front view of the second insulation ring and part (b) of FIG. 8 is a bottom view of the second insulation ring.
Figure 8:
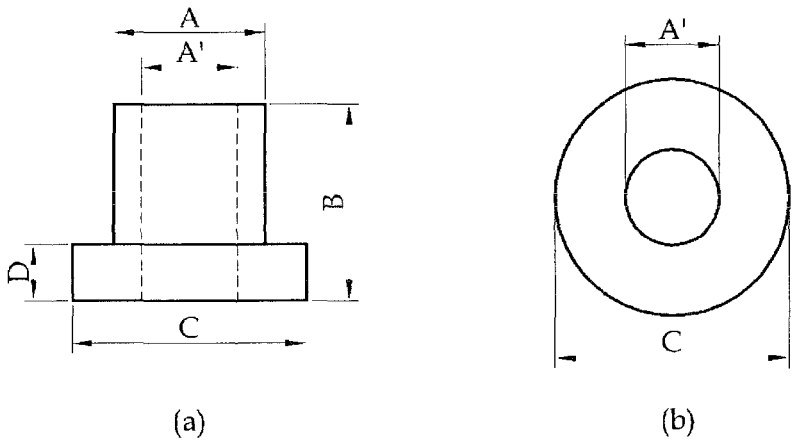

FIG. 7 is a front view for describing a second insulation ring 155 and the heat radiating body 150. Part (a) of FIG. 8 is a front view of the second insulation ring 155 and part (b) of FIG. 8 is a bottom view of the second insulation ring 155.

First, referring to FIG. 7, the closer it is to a direction in which the second insulation ring 155 is received in the through-hole 153 of the heat radiating body 150 (hereinafter, referred to as 'x' direction), the less the diameter of the second insulation ring 155 is. The closer it is to the 'x' direction, the less the diameter of the through-hole 153 is. For a concrete example, referring to (a) to (b) of FIG. 8, a step difference is formed on both an outer circumferential surface of the second insulation ring 155 and the inner circumferential surface of the heat radiating body 150, which is formed by the through-hole 153, respectively. Here, in order that the second insulation ring 155 is received and fixed in the through-hole 153, the maximum diameter C of the second insulation ring 155 is required to be larger than the minimum diameter E of the through-hole 153.

As such, when a step difference is formed on both the outer circumferential surface of the second insulation ring 155 and the inner circumferential surface of the heat radiating body 150, and when the maximum diameter C of the second insulation ring 155 is larger than the minimum diameter E of the through-hole 153, the second insulation ring 155 cannot pass through the through-hole 153. As a result, it is possible to prevent the second insulation ring 155 from entering the first receiving groove 151.

Numerical values A, A', B, C and D of the second insulation ring 155 in accordance with a TYPE of the lighting device 1 according to the present invention are shown in the following table 1. Here, TYPE 1 corresponds to a 15 watt lighting device or an 8 watt lighting device. TYPE 2 corresponds to a 5 watt lighting device. A symbol "A" corresponds to a minimum diameter (or an outer diameter) of the second insulation ring 155. A symbol of "A'" corresponds to an inner diameter of the second insulation ring 155. A symbol of "B" corresponds to a height of the second insulation ring 155. A symbol of "C" corresponds to a maximum diameter (or an outer meter) of the second insulation ring 155. A symbol of "D" corresponds to a height of a part locked in the inner circumferential surface of the heat radiating body 150.

TABLE 1

| | TYPE 1 (15 W/8 W) | TYPE 2 (5 W) |
|---|---|---|
| A | 11.8 mm | 11.8 mm |
| A' | 9.8 mm | 9.8 mm |
| B | 9.9 mm | 5.0 mm |
| C | 13.8 mm | 13.8 mm |
| D | 1.7 mm | 1.7 mm |

Figure 9:
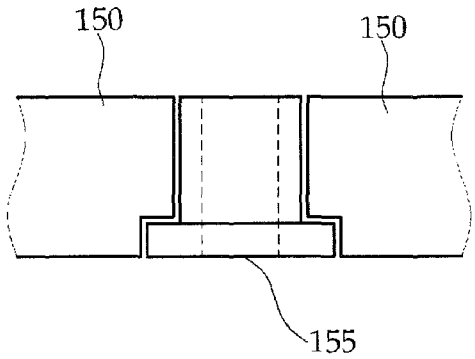
FIG. 9 is a front view showing that the second insulation ring is received in a through-hole of the heat radiating body.

FIG. 9 is a front view showing that the second insulation 155 ring is received in a through-hole 153 of the heat radiating body 150.

As shown in FIG. 9, the outer circumferential surface of the second insulation ring 155 is spaced apart at a predetermined interval from the inner circumferential surface of the heat radiating body 150. Accordingly, the second insulation ring 155 can be easily extracted from the through-hole 153 of the heat radiating body 150 at the time of working such as a change of internal parts of the lighting device.

Here, it is required that the predetermined interval should have a maximum value of 0.2 mm. That is, it is required that the diameter E of FIG. 7 be 0.2 mm larger than a minimum diameter A of the second insulation ring 155 and a diameter F of FIG. 7 be 0.2 mm larger than the maximum diameter C of the second insulation ring 155. If the predetermined interval is larger than 0.2 mm, the second insulation ring 155 cannot be easily extracted from the through-hole 153 during working. If the predetermined interval is less than 0.2 mm, the second insulation ring 155 is easily separated from the through-hole 153.

Figure 10:
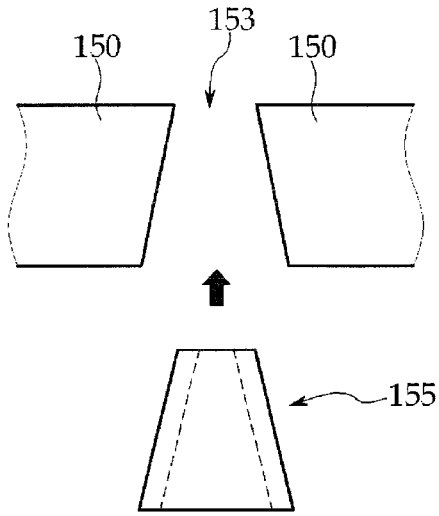
FIG. 10 is a front view showing another embodiment of the second insulation ring.

FIG. 10 is a front view showing another embodiment of the second insulation ring 155.

Referring to FIG. 10, the second insulation ring 155 has a different shape from that of the second insulation ring 155 shown in FIGS. 7 to 9. That is, the second insulation ring 155 shown in FIG. 10 has a conical shape. The closer it is to the 'x' direction, the less the diameter of the cone-shaped second insulation ring 155 is. Since such a second insulation ring 155 cannot pass through the through-hole 153, it is possible to prevent the second insulation ring 155 from entering the first receiving groove 151.

Figure 11:
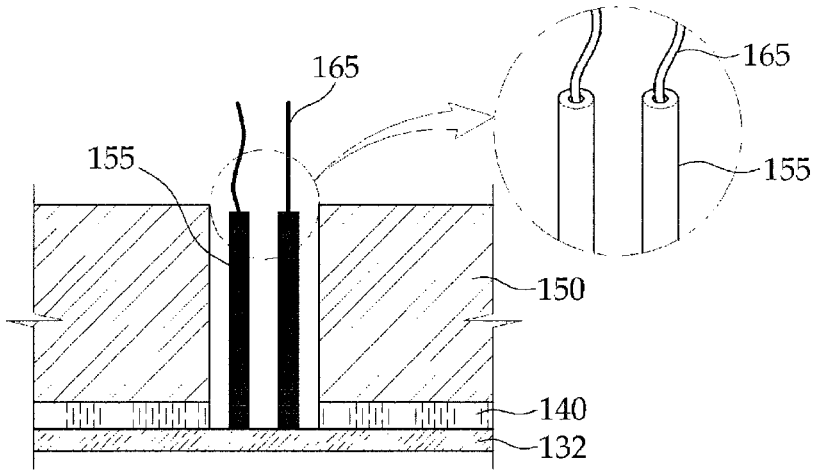
FIG. 11 is a front view showing further another embodiment of the second insulation ring.

FIG. 11 is a front view showing further another embodiment of the second insulation ring 155. More specifically, FIG. 11 substitutes for an area denoted by "P" of FIG. 4.

Referring to FIG. 11, the second insulation ring 155 of FIG. 11 has a different shape from that of the second insulation ring 155 of FIG. 4. While the second insulation ring 155 shown in FIG. 4 surrounds the inner circumferential surface of the heat radiating body 150, the second insulation ring 155 shown in FIG. 11 surrounds a conductive line 165. Here, it is preferable that the second insulation ring 155 moves along the conductive line by an external force instead of being fully close and fixed to the conductive line 165.

Since the second insulation ring 155 is formed to surround the conductive line 165, the conductive line 165 passing through the through-hole 153 is insulated from the heat radiating body 150. As a result, a withstand voltage characteristic of the lighting device 1 can be improved.

As such, though the second insulation ring 155 is described to have a ring shape in the embodiment, any means for surrounding the conductive line and insulating the heat radiating body from the conductive line will be accepted.

A first fastening member 154 is formed on a side of the lower part of the heat radiating body 150 in order to strongly couple the guide member 100 to the heat radiating body 150. The first fastening member 154 includes a hole into which a screw is inserted. The screw can strongly couple the guide member 100 to the heat radiating body 150.

In addition, so as to easily couple the guide member 100, a first width P1 of the lower part of the heat radiating body 150 to which the guide member 100 is coupled is less than a second width P2 of another part of the heat radiating body 150. However, there is no limit to the widths of the heat radiating body 150.

Light Emitting Module Substrate 130 and First Insulation Ring 120

Figure 12:
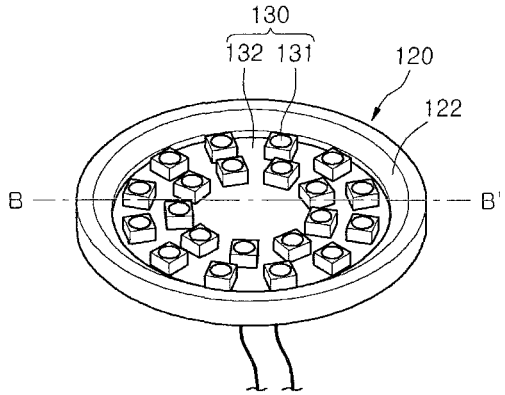
FIG. 12 is a perspective view showing coupling of a light emitting module substrate and a first insulation ring of the lighting device of FIG. 1.
Figure 13:
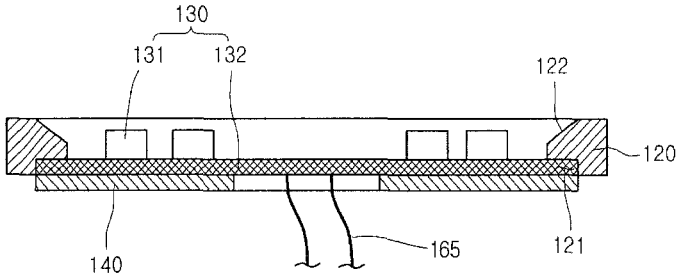
FIG. 13 is a cross sectional view taken along a line B-B' of FIG. 12.

FIG. 12 is a perspective view showing coupling of the light emitting module substrate 130 and the first insulation ring 120. FIG. 13 is a cross sectional view taken along a line B-B' of FIG. 12.

Referring to FIGS. 3, 12 and 13, the light emitting module substrate 130 is disposed in the second receiving groove 152. The first insulation ring 120 is coupled to the circumference of the light emitting module substrate 130.

The light emitting module substrate 130 includes the substrate 132 and one or a plurality of the plurality of the light emitting devices 131 mounted on the substrate 132.

The substrate 132 is made by printing a circuit pattern on an insulator. For example, a common printed circuit board (PCB), a metal core PCB, a flexible PCB and a ceramic PCB and the like can be used as the substrate 132.

The substrate 132 is made of a material capable of efficiently reflecting light. White and silver colors, etc., capable of efficiently reflecting light is formed on the surface of the substrate 132.

The one or a plurality of the light emitting devices 131 are mounted on the substrate 132. Each of a plurality of the light emitting devices 131 includes at least one light emitting diode (LED). The LEDs include various colors such as red, green, blue and white, each of which emits red, green, blue and white lights respectively. The number and kind of the LED are not limited to this.

Meanwhile, there is no limit in disposing one or more light emitting devices 131. However, in the embodiment, while the conductive line is formed under the light emitting module substrate 130, the light emitting device is not necessarily mounted on either an area of the light emitting module substrate 130, which corresponds to an area in which the conductive line has been formed or an area of the substrate 132, which corresponds to an area facing the through-hole 153. For example, as shown, when the conductive line is formed in the middle area of the light emitting module substrate 130, the light emitting device is not necessarily mounted on the middle area.

The heat radiating plate 140 is attached to the lower surface of the light emitting module substrate 130. The heat radiating plate 140 is made of a material having a high thermal conductivity such as a thermal conduction silicon pad or a thermal conduction tape and the like. The heat radiating plate 140 can effectively transfer heat generated by the light emitting module substrate 130 to the heat radiating body 150.

The first insulation ring 120 is formed of a rubber material, a silicon material or other electrical insulating material. The first insulation ring 120 is formed in the circumference of the light emitting module substrate 130. More specifically, as shown, the first insulation ring 120 includes a step difference 121 in an inner lower end thereof. The lateral surface of the light emitting module substrate 130 and the circumference of the top surface of the light emitting module substrate 130 come in contact with the step difference 121 of the inner lower end of the first insulation ring 120. An area contacting with the step difference 121 is not limited to this. Additionally, an inner upper end of the first insulation ring 120 may includes an inclination 122 in order to improve the light distribution of the light emitting module substrate 130.

The first insulation ring 120 not only prevents moisture and impurities from penetrating between the guide member 100 and the light emitting module substrate 130 but also prevents the lateral surface of the light emitting module substrate 130 from directly contacting with the heat radiating body 150. As a result, it is possible to improve a withstand voltage characteristic of the lighting device 1 and to prevent EMI, EMS and the like of the lighting device 1.

The first insulation ring 120 strongly fixes and protects the light emitting module substrate 130, improving the reliability of the lighting device 1.

Figure 16:
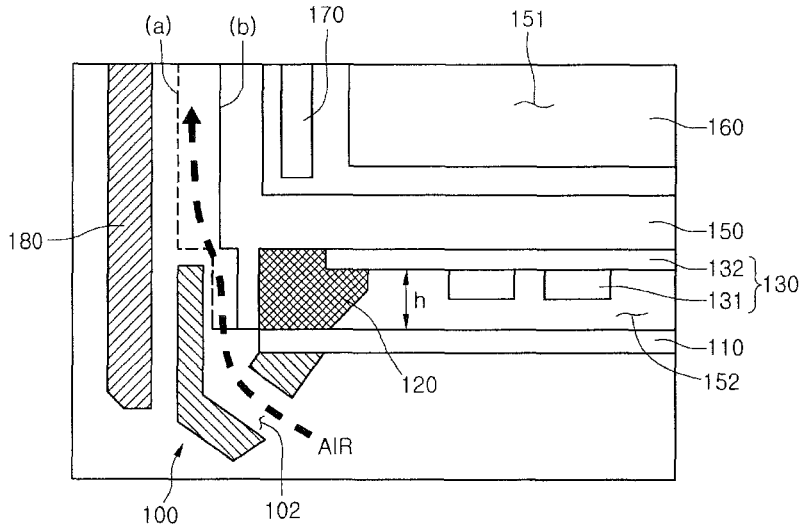
FIG. 16 is a cross sectional view showing an enlarged lower part of the lighting device of FIG. 1.

Referring to FIG. 16, when the lens 110 is disposed on the first insulation ring 120, the first insulation ring 120 allows the lens 110 to be disposed apart from the light emitting module substrate 130 by a first distance "h". As a result, it is much easier to control the light distribution of the lighting device 1.

Guide Member 100

Figure 14:
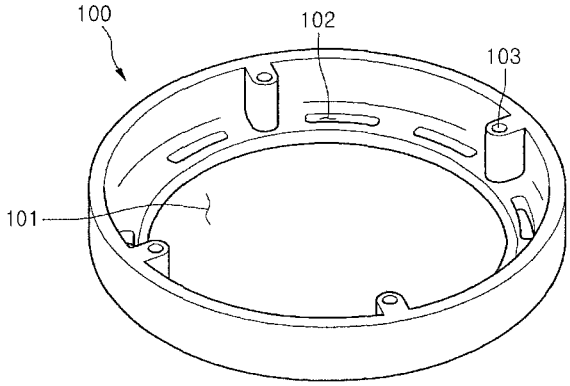
FIG. 14 is a perspective view of a guide member of the lighting device of FIG. 1.
Figure 15:
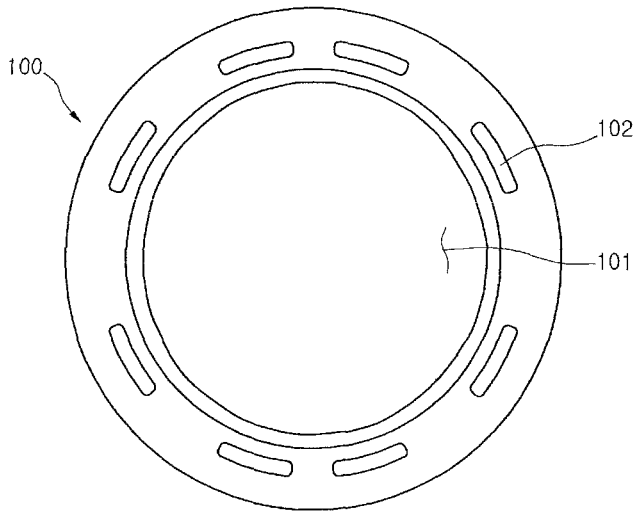
FIG. 15 is a plan view of the guide member of FIG. 14.

FIG. 14 is a perspective view of a guide member 100. FIG. 15 is a plan view of the guide member of FIG. 14.

Referring to FIGS. 4, 14 and 15, the guide member 100 includes an opening 101 for exposing the light emitting module substrate 130, a plurality of heat radiating holes 102 between the inside and the outside of the guide member 100, and a locking groove 103 coupled to the heat radiating body 150.

While the guide member 100 is shown in the form of a circular ring, the guide member 100 can have also shapes such as a polygon and an elliptical ring. There is no limit to the shape of the guide member 100.

The one or a plurality of the light emitting devices 131 of the light emitting module substrate 130 are exposed through the opening 101. Since the guide member 100 presses the light emitting module substrate 130 to the second receiving groove 152, the width of the opening 101 is required to be less than that of the light emitting module substrate 130.

More specifically, as the guide member 100 is coupled to the heat radiating body 150, the guide member 100 give a pressure to the lens 110, the first insulation ring 120 and the circumference of the light emitting module substrate 130. Accordingly, the lens 110, the first insulation ring 120 and the light emitting module substrate 130 can be securely fixed to the second receiving groove 152 of the heat radiating body 150, thereby improving the reliability of the lighting device 1.

The guide member 100 can be coupled to the heat radiating body 150 through the locking groove 103. For example, as shown in FIG. 4, a hole of the first fastening member 154 of the heat radiating body 150 is in a line with the locking groove 103 of the guide member 100. Then, the guide member 100 is coupled to the heat radiating body 150 by inserting a screw into the hole of the first fastening member 154 and the locking groove 103. However, there is no limit to the method for coupling the guide member 100 to the heat radiating body 150.

Meanwhile, when internal parts such as the driving unit 160 and the light emitting module substrate 130 and the like of the lighting device 1 are required to be changed, the guide member 100 is easily separated from the heat radiating body 150. Therefore, users can perform maintenance for the lighting device 1 without difficulty.

The plurality of the first heat radiating holes 102 are formed between the inside of the outside of the guide member 100. The plurality of the first heat radiating holes 102 allows air inside the lighting device 1 to smoothly flow, thereby maximizing heat radiation efficiency. Hereinafter, a description thereof will be provided.

Figure 17:
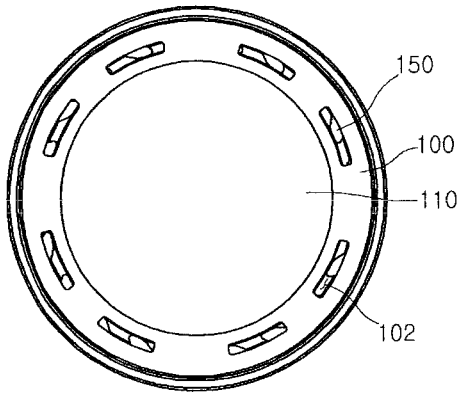
FIG. 17 is a bottom view of the lighting device of FIG. 1.
Figure 18:
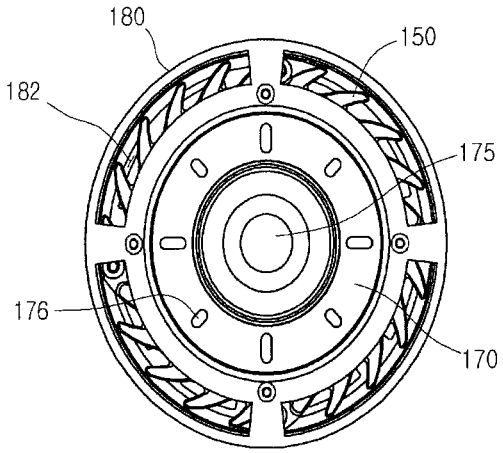
FIG. 18 is a top view of the lighting device of FIG. 1.

FIG. 16 is a cross sectional view showing an enlarged lower part of the lighting device 1 according to the embodiment. FIG. 17 is a bottom view of the lighting device 1. FIG. 18 is a top view of the lighting device 1.

Referring to FIGS. 16 to 18, air flowing into the inside of the lighting device 1 through the plurality of the first heat radiating holes 102 flows to a prominence "a" and depression "b" of the lateral surface of the heat radiating body 150. Based on a principle of air convection, the air heated by passing through the prominence and depression structure of the heat radiating body 150 can flow out through a plurality of ventilating holes 182 formed between the inner case 170 and the outer case 180. Otherwise, air flown into the plurality of the ventilating holes 182 may flow out through the plurality of the first heat radiating holes 102. Air can flow out in various ways without being limited to this.

In other words, it is possible to radiate heat by using the principle of air convection through the plurality of the first heat radiating holes 102 and the plurality of the ventilating holes 182, thereby maximizing heat radiation efficiency. Hereinafter, a description thereof will be provided.

Figure 19:
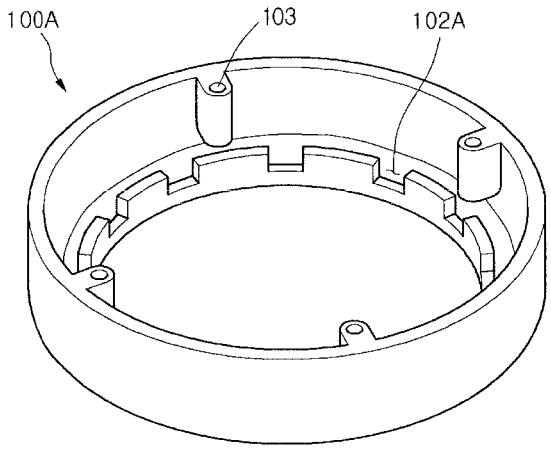
FIG. 19 is a perspective view of a guide member of a lighting device according to another embodiment.

Meanwhile, the air flow structure of the guide member 100 is not limited to this and can be changed variously. For example, as shown in FIG. 19, a guide member 100A according to another embodiment has a prominence and depression structure in the inner surface thereof, so that air can flow into the inside of the lighting device through a depression 102A.

Lens 110

Referring to FIGS. 4 and 16, the lens 110 is formed under the light emitting module substrate 130 and controls the distribution of light emitted from the light emitting module substrate 130.

The lens 110 has various shapes. For example, the lens 110 includes at least one of a parabola-shaped lens, a fresnel lens, a convex lens or a concave lens.

The lens 110 is disposed under the light emitting module substrate 130 and spaced apart from the light emitting module substrate 130 by a first distance "h". The first distance "h" is greater than 0 mm and equal to or less than 50 mm in accordance with the design of the lighting device 1.

The distance "h" is maintained by the first insulation ring 120 disposed between the light emitting module substrate 130 and the lens 110. Otherwise, if another support for supporting the lens 110 is provided in the second receiving groove 152 of the heat radiating body 150, the distance "h" is maintained between the light emitting module substrate 130 and the lens 110. There is no limit to the method for maintaining the distance "h".

The lens 110 is fixed by the guide member 110. The inner surface of the guide member 100 contacts with the lens 110. The lens 110 and the light emitting module substrate 130 are pressed and fixed to the second receiving groove 152 of the heat radiating body 150 by the inner surface of the guide member 100.

The lens 110 is made of glass, polymethylmethacrylate (PMMA) and polycarbornate (PC) and so on.

According to the design of the lighting device 1, the lens 110 includes fluorescent material. Otherwise, a photo luminescent film (PLF) including the fluorescent material is attached to a light incident surface or a light emitting surface of the lens 110. Light emitted from the light emitting module substrate 130 by the fluorescent material is emitted with a varied wavelength.

Inner Case 170

Figure 20:
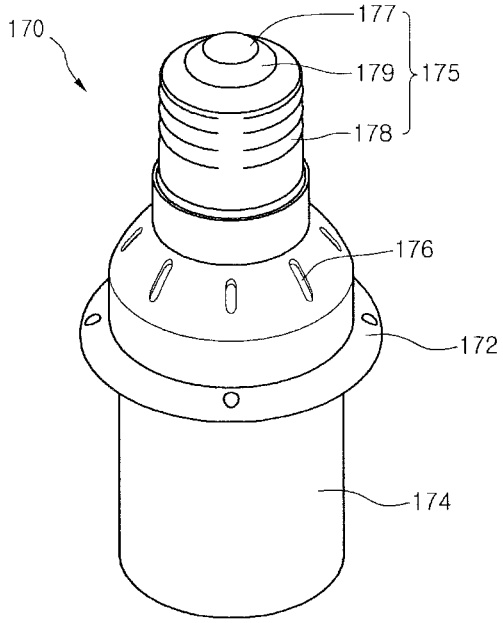
FIG. 20 is a perspective view of an inner case of the lighting device of FIG. 1.

FIG. 20 is a perspective view of the inner case 170 of the lighting device 1 of FIG. 1.

Referring to FIGS. 4 and 20, the inner case 170 includes an insertion unit 174 inserted into the first receiving groove 151 of the heat radiating body 150, a connection terminal 175 electrically connected to an external power supply, and a second fastening member 172 coupled to the outer case 180.

The inner case 170 is made of a material with excellent insulating properties and endurance, for example, a resin material.

The insertion unit 174 is formed in the lower part of the inner case 170. A side wall of the insertion unit 174 is inserted into the first receiving groove 151 so that an electrical short-circuit between the driving unit 160 and the heat radiating body 150. As a result, a withstand voltage of the lighting device 1 can be improved.

The connection terminal 175 is, for example, connected to an external power supply in the form of a socket. That is, the connection terminal 175 includes a first electrode 177 at the top thereof, a second electrode 178 on the lateral surface thereof, and an insulating member 179 between the first electrode 177 and the second electrode 178. The first and second electrodes 177 and 178 are supplied with electric power by an external power supply. Here, since the shape of the terminal 175 is variously changed based on the design of the lighting device 1, there is no limit to the shape of the terminal 175.

The second fastening member 172 is formed on the lateral surface of the inner case 170 and includes a plurality of holes. The inner case 170 is coupled to the outer case 180 by inserting screws and the like into the plurality of the holes.

Moreover, a plurality of second heat radiating holes 176 are formed in the inner case 170, improving the heat radiation efficiency of the inside of the inner case 170.

Driving Unit 160 and Internal Structure of Inner Case 170

Referring to FIG. 4, the driving unit 160 is disposed in the first receiving groove 151 of the heat radiating body 150.

The driving unit 160 includes a supporting substrate 161 and a plurality of parts 162 mounted on the supporting substrate 161. A plurality of the parts 162 include, for example, a converter converting an alternating current supplied from an external power supply into a direct current, a driving chip controlling to drive the light emitting module substrate 130, an electrostatic discharge (ESD) protective device protecting the light emitting module substrate 130. The driving unit 160 is not limited to include other components.

Here, as shown, the supporting substrate 161 is disposed vertically in order that air flows smoothly in the inner case 170. Therefore, as compared with a case where the supporting substrate 161 is disposed horizontally, air flows up and down in the inner case 170 due to air convection, thereby improving the heat radiation efficiency of the lighting device 1.

In the meantime, the supporting substrate 161 may be disposed horizontally in the inner case 170. The supporting substrate 161 can be disposed in various ways without being limited to this.

The driving unit 160 is electrically connected to the connection terminal 175 of the inner case 170 by a first conductive line 164 and to the light emitting module substrate 130 by a second conductive line 165.

Specifically, the first conductive line 164 is connected to the first electrode 177 and the second electrode 178 of the connection terminal 175 so that electric power is supplied from an external power supply.

The second conductive line 165 passes through the through-hole 153 of the heat radiating body 150 and electrically connects the driving unit 160 with the light emitting module substrate 130.

The supporting substrate 161 is disposed vertically in the inner case 170. Therefore, a long-term use of the lighting device 1 causes the supporting substrate 161 to press and damage the second conductive line 165.

Figure 21:
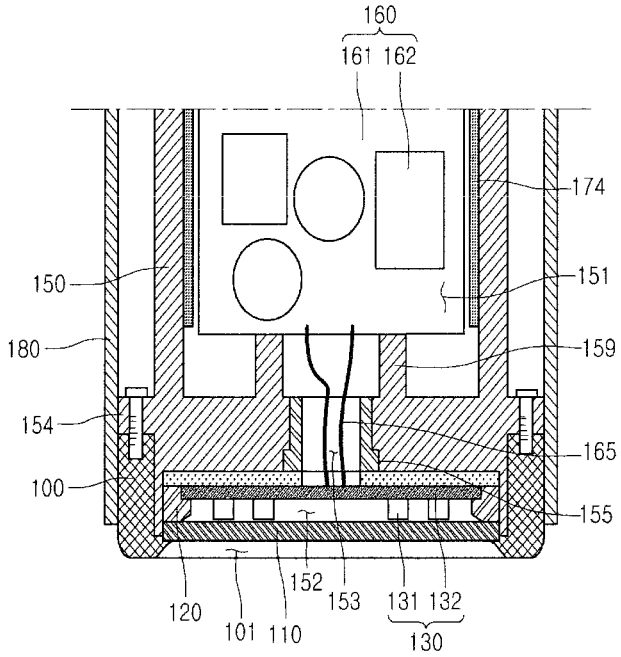
FIG. 21 is a view showing a heat radiating body of the lighting device according to the another embodiment.

Accordingly, in the embodiment, as shown in FIG. 21, a projection 159 is formed on the basal surface of the light emitting module substrate 130 in the vicinity of the through-hole 153, so that it is possible not only to support the supporting substrate 161 but to prevent in advance the second conductive line 165 from being damaged.

Outer Case 180

The outer case 180 is coupled to the inner case 170, receives the heat radiating body 150, the light emitting module substrate 130 and the driving unit 160, etc., and forms an external shape of the lighting device 1.

Since the outer case 180 surrounds the heat radiating body 150, a burn accident and an electric shock can be prevented and a user can manage the lighting device 1 with ease. Hereinafter, the outer case 180 will be described in detail.

Figure 22:
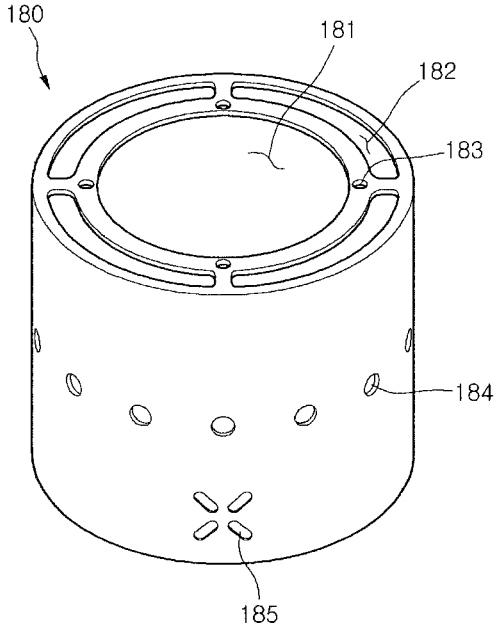
FIG. 22 is a perspective view of an outer case of the lighting device of FIG. 1.

FIG. 22 is a perspective view of an outer case 180.

Referring to FIG. 22, the outer case 180 includes an opening 181 into which the inner case 170 and the like are inserted, a coupling groove 183 coupled to the second fastening member 172 of the inner case 170, and a plurality of ventilating holes 182 for allowing air to flow into the lighting device or to flow to the outside of the lighting device.

The outer case 180 is made of a material with excellent insulation and endurance, for example, a resin material.

The inner case 170 is inserted into the opening 181 of the outer case 180. The second fastening member 172 of the inner case 170 is coupled to the coupling groove 183 by means of a screw and the like. As a result, the outer case 180 and the inner case 170 are coupled to each other.

As described above, the plurality of the ventilating holes 182 as well as the plurality of the first heat radiating holes 102 of the guide member 100 allow air to smoothly flow in the lighting device 1, thereby improving the heat radiation efficiency of the lighting device 1.

As shown, the plurality of the ventilating holes 182 are formed in the circumference of the top surface of the outer case 180. The ventilating hole 182 has an arc-shape like a fan. However, there is no limit to the shape of the ventilation hole 182. Additionally, the coupling groove 183 is formed between the plurality of the ventilating holes 182.

Meanwhile, the lateral surface of the outer case 180 may include at least a marking groove 185 and a plurality of holes 184. The hole 184 is used to enhance heat radiation efficiency. The marking groove 185 is used to easily managing the lighting device 1. However, it is not necessary to form the plurality of holes 184 and the marking groove 185. There is no limit to the formation of the hole 184 and the marking hole 185.

The features, structures and effects and the like described in the embodiments are included in at least one embodiment of the present invention and are not necessarily limited to one embodiment. Furthermore, the features, structures, effects and the like provided in each embodiment can be combined or modified in other embodiments by those skilled in the art to which the embodiments belong. Therefore, contents related to the combination and modification should be construed to be included in the scope of the present invention.

The features, structures and effects and the like described in the embodiments are included in at least one embodiment of the present invention and are not necessarily limited to one embodiment. Furthermore, the features, structures, effects and the like provided in each embodiment can be combined or modified in other embodiments by those skilled in the art to which the embodiments belong. Therefore, contents related to the combination and modification should be construed to be included in the scope of the present invention.

What is claimed is:

1. A lighting device comprising:

a substrate;

a light emitting device disposed on the substrate;

a driver to supply electric power to the light emitting device, wherein the driver is coupled to the substrate through a conductive line and includes one or more circuits to assist in conditioning the electric power for supply to the light emitting device;

a heat radiator to radiate heat from the light emitting device and comprising:

a hole through which the conductive line passes, a first receiving cavity in which the driver is disposed, and a second receiving cavity in which the substrate is disposed;

an inner case, having the driver therein, disposed in the first receiving cavity; and an insulator coupled to the hole and having an opening, wherein the light emitting device includes an LED, wherein an outer circumferential surface of the insulator is spaced apart from an inner circumferential surface of the heat radiator.

2. The lighting device of claim 1, wherein the inner case overlaps the wall of the heat radiator by a length greater than a length of the conductive line.

3. The lighting device of claim 1, wherein:

the insulator has a ring shape, the insulator has first and second ends with respective first and second diameters, with the first diameter being smaller than the second diameter, and the hole in the insulator having third and fourth ends with different diameters that are aligned with the first and second ends of the insulator, respectively.

4. The lighting device of claim 1, wherein a diameter of an upper part of the hole is different from that of a lower part of the hole.

5. The lighting device of claim 1, wherein the insulator insulates the heat radiator and the conductive line and wherein the insulator is received in the hole.

6. The lighting device of claim 1, wherein a diameter of a part of the insulator is equal or less than that of the hole.

7. The lighting device of claim 1, wherein the insulator is elastic.

8. The lighting device of claim 1, wherein a side surface of the insulator is tapered or stepped.

9. The lighting device of claim 1, wherein an outer circumferential surface of the insulator corresponds to a side wall of the hole.

10. The lighting device of claim 1, further comprising a guide member for fixing the substrate to the heat radiator, wherein one side of the guide member comprises an air flow hole on one side thereof.

11. The lighting device of claim 1, further comprising an outer case being spaced apart from an outer surface of the heat radiator and surrounding the heat radiator.

12. The lighting device of claim 1, wherein an outer surface of the heat radiator comprises at least one heat radiating fin.

13. The lighting device of claim 1, wherein the inner case overlaps a wall of the heat radiator, a horizontal axis passes through the first receiving cavity, the inner case, at least one circuit of the driver, and the wall of the heat radiator which is adjacent the first receiving cavity and which overlaps the inner case.

14. The lighting device of claim 1, further comprising:

an electrode to receive power to be conditioned by the one or more driver circuits, wherein the inner case is coupled to extend from the electrode, wherein the inner case overlaps substantially a wall of the heat radiator, and wherein the horizontal axis passes through the first receiving cavity, substantially a midpoint of the inner case, at least one circuit of the driver, and the wall of the heat radiator which is adjacent the first receiving cavity and which overlaps the inner case.

15. A lighting device comprising:

a substrate:

a light emitting device disposed on the substrate;

a driver to supply electric power to the light emitting device and coupled to the substrate through a conductive line;

a heat radiator to radiate heat generated from the light emitting device and comprising:

a hole for allowing the conductive line to pass through so as to allow the electric power to be supplied to the light emitting device, a first receiving cavity in which the driver is disposed, and a second receiving cavity in which the substrate is disposed;

an inner case to prevent the heat radiator from electrically contacting the driver, and an insulator to prevent the heat radiator from electrically contacting the conductive line, wherein the light emitting device includes an LED, wherein the heat radiator includes an upper surface coupled to the substrate, wherein the hole is formed on the upper surface of the heat radiator, and wherein an upper surface of the insulator and the upper surface of the heat radiator are substantially disposed on a same plane.

16. The lighting device of claim 15, wherein the length of the conductive line is less than one half a length of a wall of the heat radiator that surrounds the first receiving cavity.

17. The lighting device of claim 15, wherein an inner circumferential surface of the heat radiator is formed by the hole, and wherein the inner circumferential surface surrounds the insulator.

18. The lighting device of claim 15, wherein the insulator is elastic.

19. A lighting device comprising:

a heat radiator comprising a first receiving cavity on one side thereof and a second receiving cavity on the other side thereof;

a light emitter substrate disposed in the second receiving cavity;

a driver disposed in the first receiving cavity and electrically connected to the light emitter substrate through a conductive line; and an inner case, which includes the driver, disposed in the first receiving cavity, wherein the heat radiator comprises:

a hole on one side of the first receiving cavity such that the conductive line passes through the hole; and an insulator surrounded by an inner circumferential surface of the heat radiator, wherein the inner circumferential surface of the heat radiator is being formed by the hole, wherein the light emitter includes an LED, and wherein an outer circumferential surface of the insulator is spaced apart from the inner circumferential surface of the heat radiator.

* * * * *